US005576159A

United States Patent [19]

Sato et al.

[11] Patent Number: 5,576,159

[45] Date of Patent: Nov. 19, 1996

[54] PHOTOGRAPHIC ELEMENT WITH COLOR ENHANCING LAYER ADJACENT TO AN EMULSION LAYER AND AN OXIDIZED DEVELOPER SCAVENGER LAYER

[75] Inventors: Erika M. Sato, Rochester; Paul T. Hahm, Hilton; Walter H. Isaac, Penfield, all of N.Y.

[73] Assignee: Eastman Kodak Company, Rochester, N.Y.

[21] Appl. No.: 390,448

[22] Filed: Feb. 17, 1995

[51] Int. Cl.[6] ..... G03C 1/46

[52] U.S. Cl. ..... 430/504; 430/503; 430/543; 430/551; 430/567; 430/359; 430/361

[58] Field of Search ..... 430/359, 361, 430/504, 549, 551, 567, 503, 543

[56] References Cited

U.S. PATENT DOCUMENTS

| | | | |
|---|---|---|---|
| 3,892,576 | 7/1975 | Van Poucke et al. | 430/449 |
| 4,036,643 | 7/1977 | Viro et al. | 430/241 |
| 4,040,829 | 8/1977 | Ohmatsu et al. | 430/505 |
| 4,102,685 | 7/1978 | Taylor | 430/215 |
| 4,141,730 | 2/1979 | Minagawa et al. | 430/504 |
| 4,341,864 | 7/1982 | Vandewalle et al. | 430/505 |
| 4,359,521 | 11/1982 | Fryberg et al. | 430/505 |
| 4,391,884 | 7/1983 | Meyer et al. | 430/17 |
| 4,414,308 | 11/1983 | Hamada | 430/505 |
| 4,518,679 | 5/1985 | Leppard et al. | 430/372 |
| 4,543,323 | 9/1985 | Iijima et al. | 430/503 |
| 4,564,587 | 1/1986 | Watanabe et al. | 430/505 |
| 4,663,272 | 5/1987 | Nakamura | 430/542 |
| 4,686,175 | 8/1987 | Ogawa et al. | 430/505 |
| 5,266,451 | 11/1993 | Schmuck et al. | 430/504 |
| 5,364,747 | 11/1994 | Edwards et al. | 430/504 |
| 5,376,513 | 12/1994 | Mihayashi | 430/504 |

FOREIGN PATENT DOCUMENTS

| | | |
|---|---|---|
| 1178477 | 11/1984 | Canada . |
| 0062202 | 10/1982 | European Pat. Off. . |
| 53-65730 | 6/1978 | Japan . |

*Primary Examiner*—Geraldine Letscher
*Attorney, Agent, or Firm*—Paul A. Leipold

[57] ABSTRACT

The invention relates to a photographic element comprising at least one emulsion layer comprising coupler and silver halide grains, adjacent to said at least one emulsion layer a color enhancer layer comprising the same coupler as in said at least one coupler layer and adjacent to said color enhancer layer a Dox scavenging layer.

20 Claims, No Drawings

PHOTOGRAPHIC ELEMENT WITH COLOR ENHANCING LAYER ADJACENT TO AN EMULSION LAYER AND AN OXIDIZED DEVELOPER SCAVENGER LAYER

FIELD OF THE INVENTION

The invention relates a method to provide improved performance of a multilayer color photographic element. More particularly, the invention relates to providing an enhancer layer comprising a dye forming photographic coupler which is placed between a light sensitive emulsion layer that contains the same dye forming photographic coupler as in the enhancer layer and an oxidized developer scavenger layer.

BACKGROUND OF THE INVENTION

Current color papers utilize three color layers comprised of a red light sensitive cyan layer, a green light sensitive magenta layer, and blue light sensitive yellow layer. In order to increase productivity of photofinishing operations, there is a strong desire to have color papers with increased overall sensitivity. In the color negative printing system, the sensitivity of the blue color record is usually considered to be the limiting factor. One common way to increase sensitivity is to use a larger emulsion grain size. However, a larger grain size causes a number of problems.

In particular, large grain emulsions typically lead to very dense dye clouds. This results in a lowering of dye covering power. In other words, more dye is necessary to achieve the same reflection density in a color photographic reflective print. Thus, the effect is to lower the efficiency of the entire system. To achieve adequate reflection density, more color forming coupler and more silver halide must then be used in the photographic element.

These effects are especially evident in areas of high dye density, that is, in the shoulder and Dmax (area of maximum density) regions. For instance, in the case of the blue sensitive layer, a low shoulder would lead to black areas going blue and yellow colors desaturating. Likewise, for a green sensitive layer, a low shoulder would give greenish blacks and desaturated magentas, while for a red sensitive layer, reddish blacks and desaturated cyans would result.

A further effect of using large grained emulsions is a deleterious loss of color purity. The formation of very tight dye clouds causes the hue of the dye to become muddy. This happens because the tails of the spectrophotometric curve for the dye will tend to become exaggerated, and the effective hue is broader than for a more diffuse dye cloud situation. In the case of yellow dyes, the hue becomes desaturated and shifted undesirably toward orange.

Another problem with the use of large grained emulsions is the tendency for the oxidized developer (Dox) to be formed in too high of a concentration to be used effectively by the color forming coupler. Thus, more of the Dox wanders from the color record in which it was formed into adjacent layers. Typically, color photographic elements contain Dox scavenging interlayers (otherwise known as anti-color-mixing layers) to prevent interlayer color contamination. In the case of large grained emulsions, the scavenging layer effectiveness must be increased with more materials to react with excess Dox and prevent it from reaching another color forming layer. This also results in materials being wasted, since no dye is formed as a result of this process.

In some instances, the very large grained emulsions produce a local concentration of Dox that is too high to be completely used by the appropriate coupler and/or scavenged by an anticolor-mixing agent. For instance, in the case of large grained emulsions used in the blue layer, this can result in the formation of magenta colored spots in the photographic print from reaction of Dox formed in the blue layer with magenta coupler situated in the green layer.

Another problem with using large grained emulsions in order to gain additional photographic speed is an undesirably large change in sensitivity with respect to the photographic element's level of hardness. This can be very deleterious because the photographic paper must be stored until completely hardened in order to assure product uniformity. This necessitates keeping a large inventory and creates undesirable additional costs for color photographic paper manufacture.

U.S. Pat. No. 4,040,829 describes a structure where a semi-diffusable coupler layer is coated on top of the topmost emulsion layer.

European Patent Application No. 0 062 202 describes a structure in which the emulsion layers are sandwiched between two coupler containing layers.

Japanese Kokai Patent Application No. Sho 53[1978]-65730 teaches using an additional 0.01–0.3 g/m$^2$ of yellow coupler in the interlayer between the blue light sensitive layer and the green light sensitive layer.

PROBLEM TO BE SOLVED BY THE INVENTION

There remains a need for photographic paper that has an improved efficiency in color generation. There also remains a need for photographic elements that have a reduced propensity for color contamination from one layer to another. There is also a continuing need for photographic elements that have improved reflective densities, especially in the region of maximum density.

SUMMARY OF THE INVENTION

Thus, it is an object of this invention to provide a color reflective photographic paper which has improved efficiency of materials usage. It is another object of this invention to provide a photographic element with reduced sensitivity to changes in the element's level of hardness. It is a further object to provide a photographic element with higher reflective densities, especially in the shoulder and Dmax regions. Another object of the invention is to provide a color paper with more pleasing and accurate color reproduction due to better dye hue from the color forming couplers. In addition, it is an object of this invention to provide a photographic element in which there is a reduced propensity for color contamination. In a specific embodiment, this would include an element with no tendency for formation of magenta spots.

These and other objects of the invention are generally accomplished by providing a photographic element comprising at least one emulsion layer comprising coupler and silver halide grains, adjacent to said at least one emulsion layer a color enhancer layer comprising the same coupler as in said at least one coupler layer and adjacent to said color enhancer layer a Dox scavenging layer.

In a preferred embodiment, the emulsion layer is the blue sensitive layer containing yellow coupler and is adjacent to the enhancing layer that also contains yellow coupler.

ADVANTAGEOUS EFFECT OF THE INVENTION

The invention provides numerous advantages over prior products and processes. The invention provides a photographic element with a reduced sensitivity to changes in element's level of hardness. It further provides a photographic element that has higher reflected densities, especially in the shoulder and maximum density regions. It provides better color reproduction with efficient usage of coupler to generate a desired hue in the photographic element. The invention provides improved performance without increasing cost, as coupler usage does not need to be increased even though better color reproduction is achieved. These and other advantages of the invention will become apparent from the detailed discussion below.

DETAILED DESCRIPTION OF THE INVENTION

It has been found that improved photographic performance can be achieved by use of an enhancer layer which is coated between a conventional color forming layer that contains both a coupler dispersion and a light sensitive silver halide emulsion and an interlayer which contains an anti-color-mixing (antistain or Dox scavenging) agent. The enhancer layer is in contact with both the emulsion layer and the Dox scavenging layer.

In a preferred embodiment of the invention, the enhancer layer contains a yellow coupler and it is situated between a conventional blue sensitive layer (coated closest to the support) and a Dox scavenging interlayer. This enhancing layer consists of gel and coupler and does not contain a significant amount of silver halide.

In a most preferred embodiment, no additional coupler is used in the photographic element. Rather, the amount of coupler used in the conventional light sensitive layer is reduced by the amount of coupler added to the enhancer layer.

The inventive structure differs from JP 53[1978]-65730, discussed above, because the additional coupler is contained in an enhancer layer which is sandwiched between a coupler and silver containing layer on one side and an anticolor-mixing layer on the other side. In addition, in the inventive structure, no additional amount of coupler is used in the enhancer layer. Thus, in a preferred embodiment, some of the coupler normally used in the photosensitive layer is shifted into the enhancer layer and this avoids the additional cost of using more coupler in the element.

Use of a split layer format with an enhancer layer, in which part of the color forming coupler in the original photosensitive layer is coated in a separate layer that is sandwiched between the photosensitive layer containing coupler and an anticolor-mixing layer overcomes the problems found in the prior art and surprisingly also provides improved efficiency with regard to the levels of materials used in the element.

In contrast to the method of U.S. Pat. No. 4,040,829, in this invention, the intent is to use the same or another non-diffusable image coupler in the adjacent enhancer layer. In a preferred embodiment, the non-diffusable coupler would be the same in both layers and would be used in the bottom-most layers of the element.

The structure of the current invention differs from EP 0 062 202 in that it requires coating a coupler containing layer above a coupler and silver containing layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. In all layers, gelatin is typically the carrier and peptizing agent for the photographically useful materials.

While the invention will provide enhanced photographic performance for any coupler containing emulsion layer, it is preferred for use with the yellow forming layer of a conventional photographic paper. This is because the blue sensitive layer is generally limiting for overall speed of the color paper. Normally, to get the desired sensitivity to blue light, the grains in the blue sensitive layer are larger than the other two layers, and as discussed elsewhere, the greatest benefit of the invention is achieved when utilized with large grain emulsions.

In the following discussion of suitable materials for use in the emulsions and elements that can be used in conjunction with this invention, reference will be made to *Research Disclosure,* September 1994, Item 36544, published by Kenneth Mason Publications, Ltd., Dudley House, 12 North Street, Emsworth, Hampshire P010 7DQ, England, which will be identified hereafter by the term "*Research Disclosure.*" Sections hereafter referred to are Sections of the *Research Disclosure,* Item 36544.

The silver halide emulsions employed in these photographic elements can be either negative-working or positive-working. Suitable emulsions and their preparation, as well as methods of chemical and spectral sensitization, are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX. The invention finds its preferred use in negative-working color paper.

Further, it would be advantageous to practice elements of the invention in conjunction with the materials disclosed in an article entitled "Typical and Preferred Color Paper, Color Negative, and Color Reversal Photographic Elements and Processing" which was published in *Research Disclosure,* February 1995, Item 37038. In particular, Sections I–XIII, XV–XVIII, and XXIIIA are especially relevant.

Any photographic coupler known to the art can be used in conjunction with elements of the invention. Suitable couplers are described in *Research Disclosure*, Item 36544, Section X. In addition, the structures of particularly preferred couplers can be found in an article entitled "Typical and Preferred Color Paper, Color Negative, and Color Reversal Photographic Elements and Processing" which was published in *Research Disclosure,* February 1995, Item 37038, Section II.

To control the migration of various components, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to polymeric backbone. It is particularly desirable to utilize non-diffusible couplers for non-diffusable dyes.

It is understood throughout this disclosure that any reference to a substituent by the identification of a group containing a substitutable hydrogen (e.g., alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms. Typical examples of substituents include alkyl, aryl, anilino, carbonamido, sulfonamido, alkylthio, arylthio, alkenyl, cycloalkyl, and further to these exemplified are halogen, cycloalkenyl, alkinyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues.

In this invention, the presence of an interlayer containing an anticolor-mixing agent (antistain or Dox scavenger) is necessary. Typically, these scavengers are ballasted to keep them in the layer in which they were coated. The scavengers work by reducing any excess oxidized developer back to the developer form. Anticolor-mixing agents include compounds such as derivatives of hydroquinones (e.g., see U.S. Pat. Nos. 2,336,327; 2,360,290; 2,403,721; 2,701,197; 2,728,659; and 3,700,453) aminophenols, amines, gallic acid, catechol, ascorbic acid, hydrazides (e.g., U.S. Pat. No. 4,923,787), sulfonamidophenols (e.g., U.S. Pat. No. 4,447,523), and non color-forming couplers. Preferred Dox scavengers for the elements of the instant invention are ballasted derivatives of hydroquinones, such as 2,5-dioctylhydroquinone and 1,4-benzenedipentanoic acid, 2,5-dihydroxy-Δ,Δ,Δ',Δ'-tetramethyl-, dihexyl ester because of their effectiveness in blocking Dox movement.

It is also contemplated that the concepts of the discussion may be employed to obtain reflection color prints as described in *Research Disclosure,* November 1979, Item 18716, incorporated herein by reference. The photographic element may contain epoxy solvents (EP 164,961); ballasted chelating agents such as those in U.S. Pat. No. 4,994,359 to reduce sensitivity to polyvalent cations such as calcium; and stain reducing compounds such as described in U.S. Pat. Nos. 5,068,171; 5,096,805; and 5,126,234. The particular base material utilized may be any material conventionally used in silver halide color papers. Such materials are disclosed in *Research Disclosure,* September 1994, Item 36544, Section XV. It may be desired to coat the photographic element on pH adjusted support as described in U.S. Pat. No. 4,917,994. If desired, false sensitization, as described in Hahm in U.S. Pat. No. 4,902,609, can be used to provide added detail in color paper embodiments.

Due to a desire for rapid development and reduced impact on the environment, preferred emulsions for color paper elements of the invention are high in silver chloride. High silver halide emulsions have greater than 90 mole % chloride. Even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide. Bromide or iodide addition when forming the emulsion may come from a soluble halide source such as potassium iodide or sodium bromide or an organic bromide or iodide or an inorganic insoluble halide such as silver bromide or silver iodide. Soluble bromide is also typically added to the emulsion melt as a keeping addendum. It is specifically contemplated to use [100] tabular grain silver chloride emulsions, as disclosed in U.S. Pat. No. 5,320,938, in conjunction with elements of the current invention.

Color paper elements typically contain less than 0.80 $g/m^2$ of total silver. Due to the need to decrease the environmental impact of color paper processing, it is desired to decrease the amount of total silver used in the element as much as possible. Therefore, total silver levels of less than 0.65 $g/m^2$ are preferable, and levels of 0.55 $g/m^2$ are even more preferable. It is possible to reduce further the total silver used in the color paper photographic element to less than 0.10 $g/m^2$ by use of a so-called development amplication process whereby the incorporated silver is used only to form the latent image, while another oxidant, such as hydrogen peroxide, serves as the primary oxidant to react with the color developer. Such processes are well-known to the art, and are described in, for example, U.S. Pat. Nos. 4,791,048; 4,880,725; and 4,954,425; EP 487,616; International published patent applications Nos. WO 90/013,059; 90/013,061; 91/016,666; 91/017,479; 92/001,972; 92/005,471; 92/007,299; 93/001,524; 93/011,460; and German published patent application OLS 4,211,460.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. Elements of the invention can be processed by a method such as the RA-4 process of Eastman Kodak Company as is described in the *British Journal of Photography Annual* of 1988, pages 198–199.

Photographic color light-sensitive materials often utilize silver halide emulsions where the halide, for example, chloride, bromide and iodide, is present as a mixture or combination of at least two halides. The combinations significantly influence the performance characteristics of the silver halide emulsion. As explained in Atwell, U.S. Pat. No. 4,269,927, silver halide with a high chloride content, that is, light-sensitive materials in which the silver halide grains are at least 80 mole percent silver chloride, possesses a number of highly advantageous characteristics. For example, silver chloride possesses less native sensitivity in the visible region of the spectrum than silver bromide, thereby permitting yellow filter layers to be omitted from multicolor photographic light-sensitive materials. However, if desired, the use of yellow filter layers should not be excluded from consideration for a light sensitive material. Furthermore, high chloride silver halides are more soluble than high bromide silver halide, thereby permitting development to be achieved in shorter times. Furthermore, the release of chloride into the developing solution has less restraining action on development compared to bromide and this allows developing solutions to be utilized in a manner that reduces the amount of waste developing solution.

Processing a silver halide color photographic light-sensitive material is basically composed of two steps of 1) color development and 2) desilvering. The desilvering stage comprises a bleaching step to change the developed silver back to an ionic-silver state and a fixing step to remove the ionic silver from the light-sensitive material. The bleaching and fixing steps can be combined into a monobath bleach-fix step that can be used alone or in combination with the bleaching and the fixing step. If necessary, additional processing steps may be added, such as a washing step, a stopping step, a stabilizing step and a pretreatment step to accelerate development. The processing chemicals used may be liquids, pastes, or solids, such as powders, tablets or granules.

In color development, silver halide that has been exposed to light is reduced to silver, and at the same time, the oxidized aromatic primary amine color developing agent is consumed by the above-mentioned reaction to form image dyes. In this process, halide ions from the silver halide grains are dissolved into the developer, where they will accumulate. In addition the color developing agent is consumed by the aforementioned reaction of the oxidized color developing agent with the coupler. Furthermore, other components in the color developer will also be consumed and the concentration will gradually be lowered as additional development occurs. In a batch-processing method, the performance of the developer solution will eventually be degraded as a result of the halide ion buildup and the consumption of developer components. Therefore, in a development method that continuously processes a large amount of a silver halide photographic light-sensitive material, for example, by automatic-developing processors, in order to avoid a change in the finished photographic characteristics caused by the change in the concentrations of the components, some means is required to keep the concentrations of the components of the color developer within certain ranges.

For instance, a developer solution in a processor tank can be maintained at a 'steady-state concentration' by the use of another solution that is called the replenisher solution. By metering the replenisher solution into the tank at a rate proportional to the amount of the photographic light-sensitive material being developed, components can be maintained at an equilibrium within a concentration range that will give good performance. For the components that are consumed, such as the developing agents and preservatives, the replenisher solution is prepared with the component at a concentration higher than the tank concentration. In some cases a material will leave the emulsions layers that will have an effect of restraining development, and will be present at a lower concentration in the replenisher or not present at all. In other cases a material may be contained in a replenisher in order to remove the influence of a materials that will wash out of the photographic light-sensitive material. In other cases, for example, the buffer, or the concentration of a chelating agent where there may be no consumption, the component in the replenisher is the same or similar concentration as in the processor tank. Typically the replenisher has a higher pH to account for the acid that is released during development and coupling reactions so that the tank pH can be maintained at an optimum value.

Similarly, replenishers are also designed for the secondary bleach, fixer and stabilizer solutions. In addition to additions for components that are consumed, components are added to compensate for the dilution of the tank which occurs when the previous solution is carried into the tank by the photographic light-sensitive material.

The following processing steps may be included in the preferable processing steps carried out in the method in which a processing solution is applied:

1) color developing→bleach-fixing→washing/stabilizing;

2) color developing→bleaching→fixing→washing/stabilizing;

3) color developing→bleaching→bleach-fixing→washing/stabilizing;

4) color developing→stopping→washing→bleaching→washing→fixing→washing/stabilizing;

5) color developing→bleach-fixing→fixing→washing/stabilizing;

6) color developing→bleaching→bleach-fixing→fixing→washing/stabilizing.

Among the processing steps indicated above, the steps 1) and 2) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

The color developing solution used with this photographic element may contain aromatic primary amine color developing agents, which are well known and widely used in a variety of color photographic processes. Preferred examples are p-phenylenediamine derivatives. They are usually added to the formulation in a salt form, such as the hydrochloride, sulfate, sulfite, p-toluenesulfonate, as the salt form is more stable and has a higher aqueous solubility than the free amine. Among the salts listed the p-toluenesulfonate is rather useful from the viewpoint of making a color developing agent highly concentrated. Representative examples are given below, but they are not meant to limit what could be used with the present photographic element:

4-amino-3-methyl-N-ethyl-N-(β-hydroxyethyl)aniline sulfate, 4-amino-3-methyl-N-ethyl-N-(β-(methanesulfonamidoethyl) aniline sesquisulfate hydrate, 4 -amino-N,N-diethylaniline hydrochloride, 4-amino-3-methyl-N,N-diethylaniline hydrochloride, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Among the above-mentioned color developing agents, 4-amino-3-methyl-N-ethyl-N-(β-(methanesulfonamidoethyl)aniline sesquisulfate hydrate preferably is used. There may be some instances where the above-mentioned color developing agents may be used in combination so that they meet the purposes of the application.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 92/09932; U.S. Pat. No. 5,294,956; EP 559,027; U.S. Pat. No. 5,179,404; EP 559,025; U.S. Pat. No. 5,270,762; EP 559,026; U.S. Pat. Nos. 5,313,243; 5,339,131.

It has been found that the following layer structure provides the unexpected benefits of the invention:

TABLE 1A

| Layer Structure | |
|---|---|
| Conventional Structure | Inventive Structure |
| Interlayer<br>Emulsion + Coupler Dispersion | Interlayer<br>Enhancer Layer<br>Emulsion + Coupler Dispersion |

In this invention, an extra enhancer layer is situated between a conventional color forming layer that contains both a coupler dispersion and a light sensitive silver halide emulsion and an interlayer which contains an anticolor-mixing agent. In a preferred embodiment, no additional coupler is used in the photographic element. Rather, the amount of coupler used in the conventional light sensitive layer is reduced by the amount of coupler added to the enhancer layer.

The magnitude of the beneficial effects obtained by use of the invention are dependent on coupler reactivity, emulsion grain size, emulsion halide content, silver laydown, coupler laydown, and the relative amounts of coupler used in the photosensitive layer and in the enhancer layer, among other things.

The advantages of this invention are observed to be greater with increasing grain size. Generally, grain sizes are preferably in the range of 0.5 to 2.5 μm, and more preferably in the range of 0.6 to 2.0 μm, and even more preferably in the range of 0.7 to 1.5 μm. Below a grain size of around 0.5 μm little benefit is observed with the use of the inventive structure.

Further, there is a relationship between emulsion grain size, silver laydown, and the number of silver centers which affects the magnitude of the inventive effect. The number of silver centers for a high chloride silver halide emulsion can be estimated from the silver laydown and grain size by the following relationship:

$$\text{Grains/m}^2=(2.22\times10^7+\text{Ag Laydown})/(\text{Edge Length})^3$$

where silver laydown is in grams per square meter and edge length is in microns. This is particularly relevant to amplified development systems in which silver levels are dramatically reduced. Generally, the number of silver centers is preferably from $0.5\times10^6$ to $50\times10^6$ grains per square meter, more preferably from $1\times10^6$ to $40\times10^6$ grains per square meter, and most preferably from $5\times10^6$ to $25\times10^6$ grains per square meter.

For the reasons mentioned above, silver halide emulsions with greater than 90 mole % chloride are preferred, and even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide.

The enhancer layer preferably contains between 5–95% of the coupler dispersion that normally would have been used in the photosensitive layer. More preferably, this range is between 15–85% of the total amount of coupler in both the photosensitive layer and the enhancer layer, and most preferably between 25–75%.

In a preferred embodiment of the invention, the enhancer layer contains a yellow coupler and it is situated between a conventional blue sensitive layer and a Dox scavenging interlayer. This enhancing layer is comprised of gelatin and coupler and does not contain a significant amount of silver halide light sensitive emulsion. The enhancer layer may also include coupler solvents, stabilizers, and other materials such as coating aids.

TABLE 1B

| Layer Structure | |
|---|---|
| Conventional Structure | Inventive Structure |
| SOC<br>UV Absorbing Layer<br>Red Sensitive Layer<br>UV Absorbing Interlayer<br>Green Sensitive Layer<br>Interlayer<br>Blue Sensitive Layer<br>Reflective Support | SOC<br>UV Absorbing Layer<br>Red Sensitive Layer<br>UV Absorbing Interlayer<br>Green Sensitive Layer<br>Interlayer<br>Enhancer Layer<br>Blue Sensitive Layer<br>Reflective Support |

In this structure, SOC stands for simultaneous overcoat layer, which is typically present as a protective layer for the photographic element. Further, the UV Absorbing Interlayer typically is comprised of both ultraviolet absorbing materials and one or more anticolor-mixing agents to prevent cross-talk between the red and green sensitive layers.

PHOTOGRAPHIC EXAMPLES

Coupler dispersions were emulsified by methods well known to the art, and Coatings 1–12, prepared according to the structure shown in Table 1, were coated on a polyethlene resin coated paper support, that was sized as described in U.S. Pat. No. 4,994,147 and pH adjusted as described in U.S. Pat. No. 4,917,994. The polyethylene layer coated on the emulsion side of the support contained a mixture of 0.1% (4,4'-bis(5-methyl-2-benzoxazolyl) stilbene and 4,4'-bis(2-benzoxazolyl) stilbene, 12.5% $TiO_2$, and 3% ZnO white pigment. The layers were hardened with bis(vinylsulfonyl methyl) ether at 1.95% of the total gelatin weight. The components used to prepare the examples are given in Table 2.

TABLE 1

| Coating | Comment | SOC | UV | RL | UV | GL | IL | EL | BL |
|---|---|---|---|---|---|---|---|---|---|
| 1 | Comparison | S-1 | UV-1 | R-1 | UV-2 | G-1 | IL-1 | None | B-1 |
| 2 | Invention | S-1 | UV-1 | R-1 | UV-2 | G-1 | IL-1 | E-1C | B-1C |
| 3 | Comparison | S-2 | UV-3 | R-2 | UV-3 | G-2 | IL-1 | None | B-4 |
| 4 | Invention | S-2 | UV-3 | R-2 | UV-3 | G-2 | IL-1 | E-4A | B-4A |
| 5 | Comparison | S-2 | UV-3 | R-2 | UV-3 | G-2 | IL-1 | E-4D | B-4D |
| 6 | Comparison | S-2 | UV-3 | R-2 | UV-3 | G-2 | IL-1 | None | B-4 |
| 7 | Invention | S-2 | UV-3 | R-2 | UV-3 | G-2 | IL-1 | E-4C | B-4C |
| 8 | Comparison | S-2 | UV-3 | R-2 | UV-3 | G-2 | IL-1 | E-4D | B-4D |
| 9 | Comparison | S-1 | UV-1 | R-1 | UV-2 | G-1 | IL-1 | None | B-3 |

TABLE 1-continued

| Coating | Comment | SOC | UV | RL | UV | GL | IL | EL | BL |
|---|---|---|---|---|---|---|---|---|---|
| 10 | Invention | S-1 | UV-1 | R-1 | UV-2 | G-1 | IL-1 | E-3A | B-3A |
| 11 | Comparison | S-1 | UV-1 | R-1 | UV-2 | G-1 | IL-1 | None | B-2 |
| 12 | Invention | S-1 | UV-1 | R-1 | UV-2 | G-1 | IL-1 | E-2B | B-2B |

TABLE 2

| Layer | Description of formulation |
|---|---|
| S-1 | 1.08 g/m$^2$ gelatin |
| | 0.03 g/m$^2$ dioctyl hydroquinone |
| S-2 | 1.35 g/m$^2$ gelatin |
| | 0.02 g/m$^2$ dioctyl hydroquinone |
| R-1 | 1.39 g/m$^2$ gelatin |
| | 0.19 g/m$^2$ Red EM-1 |
| | 0.43 g/m$^2$ C-1 |
| | 0.41 g/m$^2$ dibutyl phthalate |
| | 0.03 g/m$^2$ butyl carbitol acetate |
| | 0.27 g/m$^2$ UVA-2 |
| | 0.0016 g/m$^2$ Potassium tolylthiosulfonate |
| | 0.00016 g/m$^2$ Potassium tolylsulfinate |
| R-2 | 1.43 g/m$^2$ gelatin |
| | 0.23 g/m$^2$ Red EM-1 |
| | 0.43 g/m$^2$ C-1 |
| | 0.41 g/m$^2$ dibutyl phthalate |
| | 0.03 g/m$^2$ butyl carbitol acetate |
| | 0.27 g/m$^2$ UVA-2 |
| UV-1 | 0.38 g/m$^2$ gelatin |
| | 0.03 g/m$^2$ UVA-1 |
| | 0.16 g/m$^2$ UVA-2 |
| | 0.07 g/m$^2$ 1,4-cyclohexylenedimethylene bis (2-ethylhexanoate) |
| | 0.05 g/m$^2$ dioctyl hydroquinone |
| UV-2 | 0.82 g/m$^2$ gelatin |
| | 0.06 g/m$^2$ UVA-1 |
| | 0.34 g/m$^2$ UVA-2 |
| | 0.16 g/m$^2$ 1,4-cyclohexylenedimethylene bis (2-ethylhexanoate) |
| | 0.10 g/m$^2$ dioctyl hydroquinone |
| UV-3 | 0.61 g/m$^2$ gelatin |
| | 0.07 g/m$^2$ UVA-1 |
| | 0.17 g/m$^2$ UVA-2 |
| | 0.09 g/m$^2$ 1,4-cyclohexylenedimethylene bis (2-ethylhexanoate) |
| | 0.03 g/m$^2$ dioctyl hydroquinone |
| G-1 | 1.59 g/m$^2$ gelatin |
| | 0.12 g/m$^2$ Green EM-1 |
| | 0.34 g/m$^2$ M-2 |
| | 0.47 g/m$^2$ tris(2-ethylhexyl)phosphate |
| | 0.37 g/m$^2$ ST-2 |
| | 0.30 g/m$^2$ ST-3 |
| G-2 | 1.24 g/m$^2$ gelatin |
| | 0.24 g/m$^2$ Green EM-1 |
| | 0.39 g/m$^2$ M-1 |
| | 0.30 g/m$^2$ tris(2-ethylhexyl)phosphate |
| | 0.13 g/m$^2$ ST-1 |
| | 0.06 g/m$^2$ butyl carbitol acetate |
| | 0.04 g/m$^2$ dioctyl hydroquinone |
| IL-1 | 0.75 g/m$^2$ gelatin |
| | 0.09 g/m$^2$ dioctyl hydroquinone |
| B-1 | 1.53 g/m$^2$ gelatin |
| | 0.28 g/m$^2$ Blue EM-2 |
| | 1.08 g/m$^2$ Y-1 |
| | 0.36 g/m$^2$ dibutyl phthalate |
| | 0.30 g/m$^2$ butyl carbitol acetate |
| | 0.26 g/m$^2$ ST-4 |
| B-1C | 1.16 g/m$^2$ gelatin |
| | 0.28 g/m$^2$ Blue EM-2 |
| | 0.54 g/m$^2$ Y-1 |
| | 0.18 g/m$^2$ dibutyl phthalate |
| | 0.15 g/m$^2$ butyl carbital acetate |
| | 0.13 g/m$^2$ ST-4 |
| B-2 | 1.04 g/m$^2$ gelatin |
| | 0.25 g/m$^2$ Blue EM-1 |
| | 0.54 g/m$^2$ Y-2 |

TABLE 2-continued

| Layer | Description of formulation |
|---|---|
| | 0.37 g/m$^2$ dibutyl phthalate |
| | 1.00 g/m$^2$ ST-5 |
| B-2B | 0.74 g/m$^2$ gelatin |
| | 0.25 g/m$^2$ Blue EM-4 |
| | 0.27 g/m$^2$ Y-2 |
| | 0.19 g/m$^2$ dibutyl phthalate |
| | 0.50 g/m$^2$ ST-5 |
| B-3 | 1.04 g/m$^2$ gelatin |
| | 0.25 g/m$^2$ Blue EM-4 |
| | 0.75 g/m$^2$ Y-3 |
| | 0.42 g/m$^2$ dibutyl phthalate |
| | 0.45 g/m$^2$ ST-5 |
| B-3A | 0.88 g/m$^2$ gelatin |
| | 0.25 g/m$^2$ Blue EM-1 |
| | 0.57 g/m$^2$ Y-3 |
| | 0.32 g/m$^2$ dibutyl phthalate |
| | 0.34 g/m$^2$ ST-5 |
| B-4 | 2.33 g/m$^2$ gelatin |
| | 0.27 g/m$^2$ Blue EM-1 or EM-3 |
| | 1.08 g/m$^2$ Y-1 |
| | 0.36 g/m$^2$ dibutyl phthalate |
| | 0.30 g/m$^2$ butyl carbital acetate |
| | 0.26 g/m$^2$ ST-4 |
| | 0.36 g/m$^2$ SF-1 |
| B-4A | 1.95 g/m$^2$ gelatin |
| | 0.27 g/m$^2$ Blue EM-3 |
| | 0.81 g/m$^2$ Y-1 |
| | 0.27 g/m$^2$ dibutyl phthalate |
| | 0.23 g/m$^2$ butyl carbital acetate |
| | 0.20 g/m$^2$ ST-4 |
| | 0.27 g/m$^2$ SF-1 |
| B-4C | 1.17 g/m$^2$ gelatin |
| | 0.27 g/m$^2$ Blue EM-3 |
| | 0.27 g/m$^2$ Y-1 |
| | 0.09 g/m$^2$ dibutyl phthalate |
| | 0.08 g/m$^2$ butyl carbitol acetate |
| | 0.07 g/m$^2$ ST-4 |
| | 0.09 g/m$^2$ SF-1 |
| B-4D | 0.78 g/m$^2$ gelatin |
| | 0.27 g/m$^2$ Blue EM-1 or EM-3 |
| E-1C | 0.37 g/m$^2$ gelatin |
| | 0.54 g/m$^2$ Y-1 |
| | 0.18 g/m$^2$ dibutyl phthalate |
| | 0.15 g/m$^2$ butyl carbital acetate |
| | 0.13 g/m$^2$ ST-4 |
| E-2B | 0.30 g/m$^2$ gelatin |
| | 0.27 g/m$^2$ Y-2 |
| | 0.19 g/m$^2$ dibutyl phthalate |
| | 0.50 g/m$^2$ ST-5 |
| E-3A | 0.16 g/m$^2$ gelatin |
| | 0.19 g/m$^2$ Y-3 |
| | 0.11 g/m$^2$ dibutyl phthalate |
| | 0.11 g/m$^2$ ST-5 |
| E-4A | 0.39 g/m$^2$ gelatin |
| | 0.27 g/m$^2$ Y-1 |
| | 0.09 g/m$^2$ dibutyl phthalate |
| | 0.08 g/m$^2$ butyl carbitol acetate |
| | 0.07 g/m$^2$ ST-4 |
| | 0.09 g/m$^2$ SF-1 |
| E-4C | 1.09 g/m$^2$ gelatin |
| | 0.81 g/m$^2$ Y-1 |
| | 0.27 g/m$^2$ dibutyl phthalate |
| | 0.23 g/m$^2$ butyl carbital acetate |
| | 0.20 g/m$^2$ ST-4 |
| | 0.27 g/m$^2$ SF-1 |
| E-4D | 1.57 g/m$^2$ gelatin |

TABLE 2-continued

| Layer | Description of formulation |
|---|---|
| | 1.08 g/m$^2$ Y-1<br>0.36 g/m$^2$ dibutyl phthalate<br>0.30 g/m$^2$ butyl carbital acetate<br>0.26 g/m$^2$ ST-4<br>0.36 g/m$^2$ SF-1 |

Silver chlorobromide emulsions (99% Cl) were chemically and spectrally sensitized as is described below.

Blue Sensitive Emulsion (Blue EM-1, prepared similarly to that described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. The resultant emulsion contained cubic shaped grains of 0.79 μm in edgelength size. This emulsion was optimally sensitized by the addition of a colloidal suspension of aurous sulfide and heat ramped up to 60° C. during which time blue sensitizing dye BSD-1,1-(3-acetamidophenyl)-5-mercaptotetrazole and potassium bromide were added. In addition, iridium dopant was added during the sensitization process.

Blue EM-2 (1.2 μm), Blue EM-3 (1.35 μm) and Blue EM-4 (0.6 μm) were prepared similarly to that described for Blue EM-1.

Green Sensitive Emulsion (Green EM-1): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. Iridium dopant was added during the late stage of grain formation. The resultant emulsion contained cubic shaped grains of 0.30 μm in edgelength size. This emulsion was optimally sensitized by addition of green sensitizing dye GSD-1, a colloidal suspension of aurous sulfide, heat digestion followed by the addition of 1-(3-acetamidophenyl)-5-mercaptotetrazole and potassium bromide.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edgelength size. This emulsion was optimally sensitized by the addition of a colloidal suspension of aurous sulfide followed by a heat ramp, and further additions of 1-(3-acetamidophenyl)-5-mercaptotetrazole, potassium bromide and red sensitizing dye RSD-1. In addition, iridium dopant was added during the sensitization process.

Structures

BSD-1

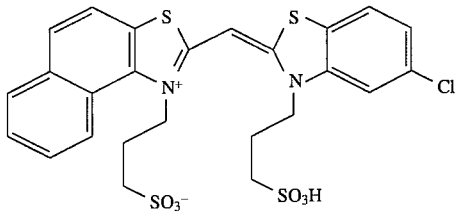

GSD-1

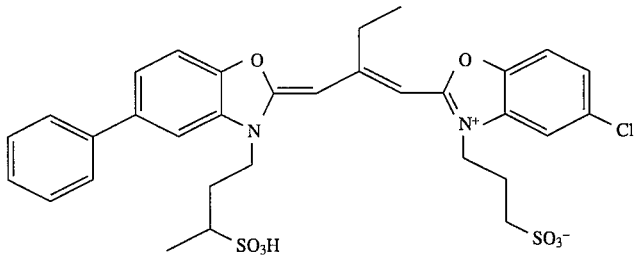

RSD-1

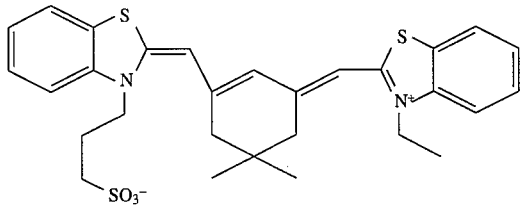

-continued
Structures
UVA-1
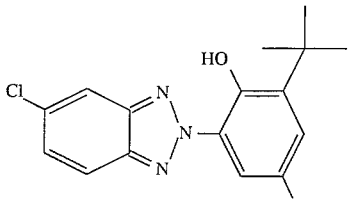
UVA-2
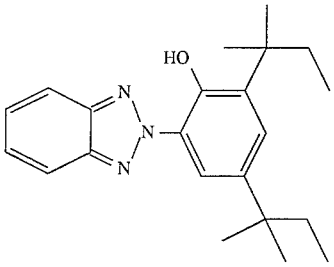
C-1
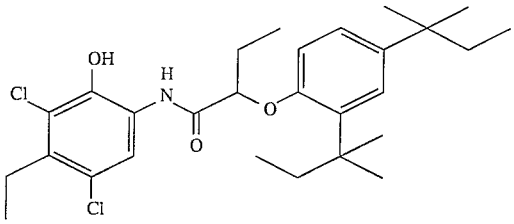
M-1
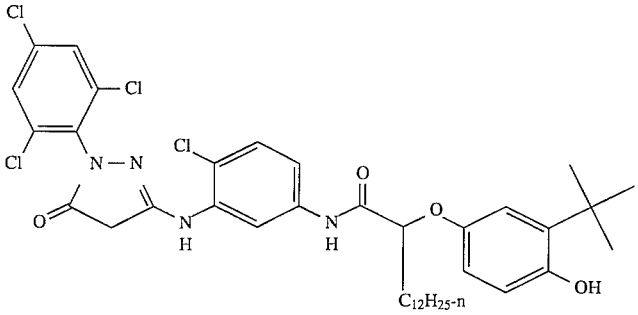
M-2
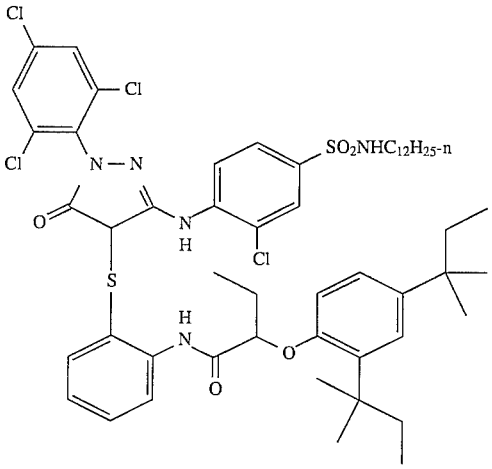

-continued
Structures
Y-1
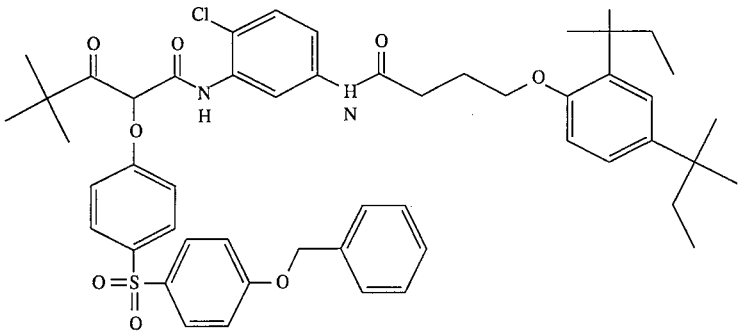
Y-2
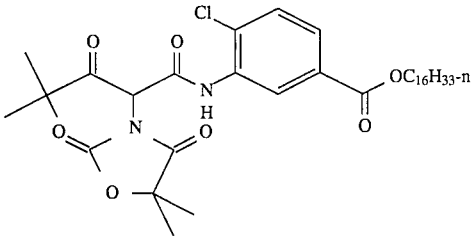
Y-3
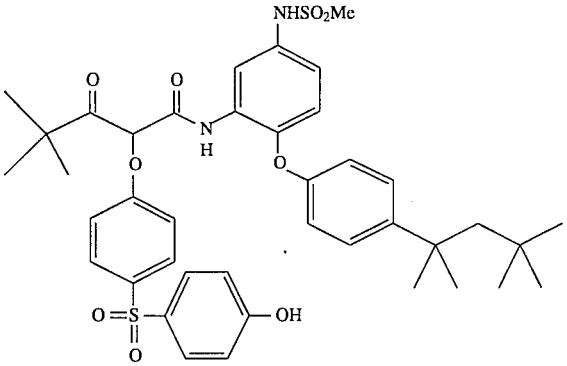
ST-1
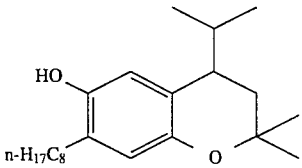
ST-2
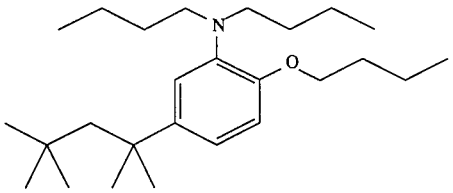
ST-3
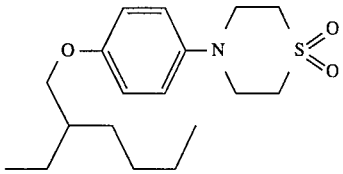

-continued

Structures

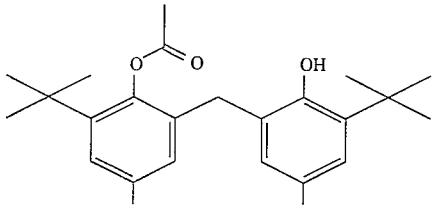

ST-4

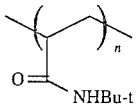

n = 75–8,000

ST-5

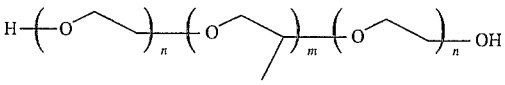

n = ca. 6, m = ca. 22

SF-1

The coatings were given a red, green and blue stepped exposure and processed through the Kodak RA-4 process, described in the *British Journal of Photography Annual* of 1988, pp 190–199, comprising the following processing solutions, times and temperatures to give the results shown in Table 3.

TABLE 3

| | | |
|---|---|---|
| Developer | 45 sec | 35° C. |
| Bleach-Fix | 45 sec | 35° C. |
| Wash | 1 min, 30 sec | 33–44° C. |

| Coating | Comment | Grain Size (μm) | Coupler in Enhancer Layer | Relative Blue Shoulder | Blue Shoulder Loss (28 Day) |
|---|---|---|---|---|---|
| 1 | Comparison | 1.2 | 0% | — | −0.13 |
| 2 | Invention | 1.2 | 50% | 0.08 | −0.04 |
| 3 | Comparison | 0.79 | 0% | — | −0.10 |
| 4 | Invention | 0.79 | 25% | 0.09 | −0.10 |
| 5 | Comparison | 0.79 | 100% | −0.32 | 0.01 |
| 6 | Comparison | 1.35 | 0% | — | −0.28 |
| 7 | Invention | 1.35 | 75% | 0.12 | −0.20 |
| 8 | Comparison | 1.35 | 100% | −0.01 | −0.09 |
| 9 | Comparison | 0.6 | 0% | — | 0.01 |
| 10 | Invention | 0.6 | 25% | 0.05 | 0.00 |
| 11 | Comparison | 0.79 | 0% | — | −0.05 |
| 12 | Invention | 0.79 | 50% | 0.03 | −0.01 |

Status A blue shoulder density was obtained from the D log E curve. The speed point is defined as the speed of the coating at 0.80 density. The Status A blue shoulder is then found by determining the density at 0.40 log E slow of the speed point. The Relative Blue Shoulder Density is the difference in shoulder density obtained for elements of the invention relative to a check coating. The only difference between the invention versus the check (i.e., coating 1 versus 2, coating 4 versus 3 and 5, etc.) is the amount of coupler coated in the Enhancer Layer. The Blue Shoulder Loss (28 Day) is the amount of the shoulder density change after storage of the photographic element for 28 days at room temperature relative to the density obtained for the fresh coating.

As is seen in Table 3, when an inventive amount of yellow coupler is placed in an enhancer layer above the conventional blue sensitive layer, the reflection density of the invention coatings is higher than for the comparison coatings. For instance, the blue shoulder density increased by 0.09 by coating 50% of the total yellow coupler in the enhancer layer versus 0% in the enhancer layer (Coating 4 versus Coating 3).

In addition, the inventive structure mitigates the loss of blue density seen upon aging of the check coating for 28 days. For instance, Coating 2 loses only 0.04 units of shoulder density while Coating 1 losses 0.13 units.

Further, it should be noted that placing all of the yellow coupler in the enhancer layer is undesirable. For example, the relative shoulder of comparison Coating 5 loses 0.32 density units while inventive Coating 4 gains 0.09 units.

The invention has been described in detail with particular reference to preferred embodiments thereof, but it will be understood that variations and modifications can be effected within the spirit and scope of the invention.

We claim:

1. A photographic element comprising at least one emulsion layer wherein said at least one emulsion layer comprises non-diffusible coupler and silver halide grains, adjacent to said at least one emulsion layer a color enhancer layer comprising a non-diffusible coupler, and adjacent to said color enhancer layer an oxidized developer scavenging layer, with the proviso that said color enhancer layer does not contain silver halide.

2. The element of claim 1 wherein the said at least one emulsion layer comprises blue sensitive silver halide and yellow dye forming coupler.

3. The element of claim 1 wherein said oxidized developer scavenger layer comprises 2,5-dioctylhydroquinone and 1,4-benzenedipentanoic acid, 2,5-dihydroxy-Δ,Δ,Δ',Δ'-tetramethyl-, dihexyl ester.

4. The element of claim 1 wherein of the total of the coupler in said at least one emulsion layer and in said adjacent enhancer between about 5 and 95 weight percent is in the enhancer layer.

5. The element of claim 4 wherein between about 15 and about 85 weight percent of said coupler is in the enhancer layer.

6. The element of claim 4 wherein between about 25 and about 75 weight percent of said coupler is in the enhancer layer.

7. The element of claim 1 wherein said non-diffusable couplers are the same coupler.

8. The element of claim 1 wherein said silver halide grains high chloride grains of between about 0.5 and 2.5 microns.

9. The element of claim 1 wherein said couplers form dye of the same color.

10. The element of claim 9 wherein said grains are between about 0.7 and 1.5 microns and are blue sensitized.

11. The element of claim 1 wherein the number of silver centers in said silver halide grains of said at least one emulsion layer is between about $0.5\times10^6$ to $50\times10^6$ grains per square meter.

12. The element of claim 1 wherein the number of silver centers in said silver halide grains of said at least one emulsion layer is between about $1\times10^6$ to $40\times10^6$ grains per square meter.

13. The element of claim 1 wherein the number of silver centers in said silver halide grains of said at least one emulsion layer is between about $5\times10^6$ to $25\times10^6$ grains per square meter.

14. A photographic element comprising at least one layer wherein said at least one layer comprises a blue sensitive emulsion and yellow dye forming coupler, adjacent to said at least one layer comprising said blue sensitive emulsion is at least one yellow enhancer layer comprising a yellow coupler, and adjacent to said yellow enhancer layer an oxidized developer scavenging layer, with the proviso that said color enhancer layer does not contain silver halide.

15. A photographic element as in claim 14 wherein said yellow enhancer layer contains between about 15 and 85 percent of the total yellow coupler in said photographic element.

16. A photographic element as in claim 14 wherein said blue sensitive emulsion comprises silver halide grains that have an average grain size of about 0.7 to 1.5 micron.

17. The photographic element of claim 14 wherein said element further comprises a reflective support.

18. The photographic element of claim 16 wherein said emulsion comprises silver halide emulsion which is at least 90 percent chloride.

19. The photographic element of claim 14 wherein said oxidized developer scavenging layer comprises at least one material selected from the group consisting of 2,5-dioctylhydroquinone, 1,4-benzenedipentanoic acid, and 2,5-dihydroxy-Δ,Δ,Δ',Δ'-tetramethyl-, dihexyl ester.

20. The element of claim 14 wherein said enhancer layer contains between about 25 and about 75 percent of the total yellow dye forming coupler in said element.

* * * * *